US005897952A

United States Patent [19]

Vigo et al.

[11] Patent Number: 5,897,952

[45] Date of Patent: Apr. 27, 1999

[54] TEMPERATURE ADAPTABLE GLYOXAL-MODIFIED FIBERS AND METHOD OF PREPARING SAME

[75] Inventors: Tyrone L. Vigo; Gary F. Danna, both of New Orleans; Joseph S. Bruno, Chalmette, all of La.

[73] Assignee: The United States of America as represented by the Secretary of Agriculture, Washington, D.C.

[21] Appl. No.: 07/863,274

[22] Filed: Apr. 3, 1992

[51] Int. Cl.[6] ..... D06M 11/00

[52] U.S. Cl. ..... 428/393; 428/364; 428/375; 428/378; 428/394; 428/395; 428/396; 428/913

[58] Field of Search ..... 428/378, 392, 428/393, 395, 394, 364, 913, 396; 8/115.51, 115.6

[56] References Cited

U.S. PATENT DOCUMENTS 3,607,591 9/1971 Hansen ..... 161/77

4,472,167 9/1984 Welch ..... 8/116.4

4,851,291 7/1989 Vigo et al. ..... 428/393

4,908,238 3/1990 Vigo et al. ..... 427/389

*Primary Examiner*—Pamela R. Schwartz

*Assistant Examiner*—Jill M. Gray

*Attorney, Agent, or Firm*—M. Howard Silverstein; John D. Fado; Joseph A. Lipovsky

[57] ABSTRACT

Temperature adaptable fibers are provided in which a polyol/glyoxal based crosslinking system is used to create a water-insoluble polyacetal coating. The formaldehyde release properties characteristic of methylolamide finishing agents is avoided. The non-catalytic reaction utilizes stoichimetric amounts of sulfonic acids to derivatize the polyols which in turn react with the glyoxal to form a water-insoluble polymer. The material also possesses improved properties relating to soil release, durable press, resistance to static charge, abrasion resistance, pilling resistance and water absorbency.

6 Claims, No Drawings

TEMPERATURE ADAPTABLE GLYOXAL-MODIFIED FIBERS AND METHOD OF PREPARING SAME

FIELD OF THE INVENTION

This invention relates to temperature-adaptable polyacetal modified fibers and the means for their production.

DESCRIPTION OF THE PRIOR ART

The concept of preparing a temperature-adaptable hollow fiber has been previously demonstrated and described in U.S. Pat. No. 3,607,591. This invention incorporates a gas into liquid inside the fiber that increases the diameter of the fiber and thus increases its thermal insulation value when the liquid solidifies and the solubility of the gas decreases. However, this invention exhibits serious limitations. It is limited to use with only hollow textile fibers and is only applicable in cold weather situations, i.e., when the environmental temperature drops below the freezing point of the liquid in the fiber. Furthermore, this modified hollow fiber system was not evaluated for its ability to reproduce its thermal effect after various heating and cooling cycles.

U.S. Pat. Nos. 4,851,291 and 4,908,238 describe and demonstrate the concept of preparing temperature-adaptable fibers by means of an in-situ polymerization process. The inventions require that the polyethylene glycols be insolubilized by reaction with cross-linking agents possessing three or more reactive sites; further, the inclusion of specific acid catalysts such as p-toulenesulfonic acid by itself or in a mixture with other acid catalysts such as $MgCl_2$ and citric acid is necessary.

U.S. Pat. No. 4,472,167 describes the preparation of formaldehyde-free durable-press finishes on cotton textiles. Glycols possessing a molecular chain length of 2 to 11 atoms are used as coreactive additives with glyoxal in the presence of aluminum sulfate catalysts and alpha-hydroxy catalyst activators to create textile finishes exhibiting high levels of wrinkle resistance and smooth drying properties.

SUMMARY OF THE INVENTION

It has now been found that modified textile fibers containing bound polyacetals can be produced by a previously unrecognized reaction involving the in situ polymerization of linear polyethylene glycols with stoichiometric amounts of sulfonic acids and glyoxal; this being done in the presence of the fibrous substrates. The insoluble polyacetal is derived from non-formaldehyde reactants (glyoxal) and high molecular weight polyethylene glycols. The resultant polyacetal is insolubilized onto diverse types of natural and synthetic fibers and/or their blends by immersing the fibrous materials in solutions containing the polyethylene glycols, sulfonic acids and glyoxal or applying the solution to the fibrous materials by other methods such as coating, low wet pickup or spraying techniques. To effect the polymerization, excess solution is removed and the fibrous materials are dried and cured at appropriate temperatures and times. The resultant products are modified fibers that have improved thermal storage and release properties. Properties including soil release, durable press, resistance to static charge, abrasion resistance, pilling resistance, and water absorbency are also enhanced. Furthermore, this insolubilization process is amenable to all types of fibrous constructions (woven, nonwoven, and knit).

Fabrics and fibrous products made from such modified fibers have numerous consumer, biomedical, agricultural, aerospace, defense, automotive and other applications that can utilize the unique set of multifunctional properties of the modified materials.

DESCRIPTION OF THE PREFERRED EMBODIMENTS

The instant invention is based upon the formation and deposition of water-insoluble polyacetals on fibers of either natural or synthetic origin. The reaction involves the in situ polymerization of linear polyethylene glycols with stoichimetric amounts of sulfonic acids and glyoxal. Fibers which may be treated by means of the instant invention include fibrous substrates such as wood pulp and paper, cellulosic fibers such as cotton or rayon, regenerated cellulosic fibers, proteinaceous fibers such as wool and silk, polyesters, polypropylenes, polyamids, glass, acrylics and elastomerics such as polyurethane. The fibers may be used singularly or in the form of blends containing one or more constituents.

For fibers possessing a content of at least about 50% by weight cellulose, it is desirable to expose them first to an alkaline pretreatment for the purpose of rendering the fabric capable of retaining acceptable tensile strength after the in situ formation of polyacetals. For such pretreatments, the fabrics are immersed in an aqueous alkali, preferably sodium or potassium hydroxide, in a concentration of about 5% to about 25% by weight for about 2 to about 10 minutes at a temperature ranging from about 10° C. to about 40° C., preferably about 15° C. to about 25° C. The fabric is then washed until the pH of the wash water is from about 7 to about 9. The fabric may then be optionally dried by means conventional in the art prior to polyacetalation.

The formation of insolubilized crosslinked polyacetals upon the fabrics requires that polyethylene glycol, sulfonic acid, and glyoxal reactants be present so as to react in stoichimetric amounts. A proposed mechanism for the reaction requires that the sulfonic acid react with the end groups of the polyethylene glycol to form polyol sulfonate intermediates. The polyol sulfonates in turn react with the glyoxal to form a cross-linked water-insoluble polyacetal polymer. Another plausible mechanism is the initial formation of sulfonate hemiacetals or acetals of glyoxal and subsequent reaction of these intermediates with polyethylene glycols to form polyacetals. The mechanics in which the polyol sulfonates functioned as good leaving groups for this reaction was totally unexpected.

Polyethylene glycols useful in the above reaction for producing fabrics with improved thermal storage and release properties are those with molecular weights ranging from about 600 to about 100,000; with a range from about 1,000 to about 20,000 being preferred. Useful sulfonic acids are any of those which directly or indirectly derivative polyol end groups and may be either aromatic or aliphatic; with p-toluenesulfonic acid and methanesulfonic acid being preferred. The glyoxal may be used either in its standard form or as the trimer dihydrate in aqueous solution. While weight ratios of reactants will vary based on their particular molecular weights, typical formulations are aqueous solutions comprising by weight from about 20% to about 60% polyol, about 2% to about 35% sulfonic acid and about 5% to about 25% glyoxal. While non-stoichimetric ratios of reactants can be utilized, the molar ratios preferred to effect optimum polyacetal formation are 1:2:4 for the polyol, sulfonic acid and glyoxal constituents, respectively. These three classes of reactants may be present as a singular chemical species or as a mixture of one or more compounds of that class.

The fiber or fabric to be treated is immersed in the aqueous reactant solution. A wet pickup of about 50% to about 300% is desired and is achieved by the removal of excess solution through means conventional in the art such as squeeze rolls. The treated material is then dried for about 2 to about 10 minutes at temperatures from about 70° C. to about 90° C. Curing is then done by subjecting the material to a temperature ranging from about 110° C. to about 170° C. for a time ranging from about 0.25 minutes to about 10 minutes. A single step dry/cure procedure may alternatively be used in which the material is heated for about 1 to about 10 minutes at a temperature ranging from about 100° C. to about 180° C. It should be noted that cure temperatures below about 125° C. are desirable for materials containing cellulosic,wool, or elastomeric fibers so as to prevent yellowing and substantial strength losses. A desired deposition rate of the polyacetal on the material ranges from about 0.1 g to about 1 g of polyacetal per gram of material.

A post-treatment comprising immersion in an aqueous alkali is preferred for all treated materials that are stable to such for the purpose of removing any residual acid formed during the polymerization and improving durability of the bound polyacetal by minimizing the reversibility of the polymerization reaction. The post-treatment is carried out with the same constituents, concentrations and under the same conditions as set forth regarding the pretreatment.

After treatment and the optional post-treatment, the material is then optionally washed to remove any residues and then dried. The materials treated in accordance with this invention have improved thermal adaptability, i.e., the ability to release heat when the temperature drops and absorb heat when the temperature rises. The range at which the fabrics are thermally active may be as low as about −20° C. and as high as +55° C., and can be controlled by use of particular precursor polyols and curing conditions.

Fabrics or fibrous substrates retain appreciable amounts of the bound polyacetal and their improved functional properties for up to 30 launderings.

The following examples are presented only to further illustrate the invention and are not intended to limit the scope of the invention which is defined by the claims.

EXAMPLE 1

Incorporation of Polyacetal (derived from reaction of av. molecular wt. PEG-300, p-toluenesulfonic acid and glyoxal) into 100% cotton and 65/35 Cotton/Polyester Fabrics 100% desized, scoured and bleached cotton printcloth (3.7 oz/yd$^2$; thread count 80 warp×80 fill; 12 in. wide×16 in. long) and 65/35 cotton/polyester printcloth fabrics (2.4 oz/yd$^2$; thread count 80 warp×80 fill; 12 in. wide×16 in long) were immersed in an aqueous solution containing by weight 45% polyethylene glycol av. mol. wt. 300 (0.15 moles)—14.4% glyoxal (0.248 moles)—19.0% p-toluenesulfonic acid monohydrate (0.10 moles) at 25° C., then excess solution removed by running the treated fabric through squeeze rolls at 50 lbs. pressure to wet pickups respectively of 100% for each type of fabric. The fabrics were then mounted on a pin frame, and dried and cured in a single step (2 min. at 115° C. in a forced-draft oven). The treated fabrics were subsequently washed for 15 min. at 50° C. with running tap water and liquid detergent prior to tumble drying or oven drying for 5 min. at 85° C. The resultant fabrics had weight gains respectively of 43% (0.43 grams per gram of fiber for all cotton fabric) and 34% (0.34 grams per gram of fiber for the cotton/polyester blend fabric). The modified fabrics were conditioned at standard atmospheric conditions (65% RH/70° F.) and evaluated for their non-thermal properties. Neither fabric had any appreciable thermal activity because of the low crystallinity of the polyol used to form the insoluble polyacetals. Other textile properties of the treated cotton fabric were improved relative to the untreated cotton fabric as follows: (a) flat abrasion cycles to failure (728 for treated vs 315 for untreated); (b) conditioned wrinkle recovery angle-warp+fill directions (273 for treated vs 200 for untreated); and (c) % moisture content—water loss after heating to constant weight at 110° C. (9.6 for treated vs 7.0 for untreated). Similar improvements in the treated cotton/polyester fabric relative to the untreated blend fabric were as follows: (a) flex abrasion cycles to failure (3,160 for treated vs 1,960 for untreated); (b) conditioned wrinkle recovery angle-warp+fill directions (273 for treated vs 230 for untreated); (c) breaking strength in lb. (48.7 for treated vs 42.3 for untreated); and (d) % moisture content—water loss after heating to constant weight at 110° C. (8.2 for treated vs. 5.0 for untreated).

EXAMPLE 2

Incorporation of Polyacetal (derived from reaction of av. molecular wt. PEG-1,000, p-toluenesulfonic acid and glyoxal) into Cotton Fabric 100% desized, scoured and bleached cotton printcloth (3.7 oz/yd$^2$; thread count 80 warp×80 fill; 12 in. wide×16 in. long) was immersed in an aqueous solution containing by weight 45% polyethylene glycol av. mol. wt. 1,000 (0.045 moles)—14.4% glyoxal (0.248 moles)—19.0% p-toluenesulfonic acid monohydrate (0.10 moles) at 25° C., then excess solution removed by running the treated fabric through squeeze rolls at 40 lbs. pressure to a wet pickup of 102%. The fabric was then mounted on a pin frame, dried 5 min. at 85° C. in a forced-draft oven, then cured an additional 2 min. at 135° C. in the same oven. The treated fabric was subsequently washed for 15 min. at 50° C. with running tap water and liquid detergent prior to tumble drying or oven drying for 5 min. at 85° C. The resultant fabric had a weight gain or add-on of 41% (0.41 grams per gram of fiber). The modified fabric was conditioned at standard atmospheric conditions (65% RH/70° F.) and evaluated for its thermal and non-thermal properties. It absorbed thermal energy after one heating cycle (−40 to +70° C.) of 16.7 Joules/gram, with maximum absorption (cooling effect) at 16° C.; conversely, on cooling from +70 to −40° C., it released heat of 10.5 Joules/gram with maximum heat release at −5° C. In contrast, unmodified cotton fabric exhibited no heat absorption and heat release effects when heated or cooled in the above temperature ranges. Other textile properties in the treated fabric were improved relative to the untreated cotton fabric: (a) flat abrasion cycles to failure (300 for treated vs 230 for untreated); (b) conditioned wrinkle recovery angle-warp+fill directions (273 for treated vs 200 for untreated); (c) oily soil release using a modified Milliken Test Method DMRG-TT-100 in which the fabrics were soiled then washed and their reflectance values measured (100% reflectance retention for treated vs 78% reflection retention for untreated); (d) residual static charge in ohms×10$^8$ at 65% relative humidity (2,606 for treated vs 16,105 for untreated).

EXAMPLE 3

Incorporation of Polyacetal (derived from reaction of av. molecular wt. PEG-1,000, p-toluenesulfonic acid and glyoxal) into Cotton Fabric Given a Pre- and Post alkaline Treatment 100% desized, scoured and bleached cotton printcloth (3.7 oz/yd$^2$; thread count 80 warp×80 fill; 12 in. wide×16 in. long) was immersed in aqueous 25% NaOH for 5 min. at 25° C., then washed in running tap water for 15 min. or until the wash water was slightly alkaline and dried for 5 min. at 85° C. The pretreated cotton fabric was then immersed in a solution used in Example 2 to a wet pickup of 98%, and also dried and cured as in Example 2. The cured fabric was post-treated with 25% NaOH for 2 min. at 25° C., washed in running tap water for 15 min., then oven-dried for 5 min. at 85° C. The resultant fabric had a weight gain or add-on of 39% (0.39 grams per gram of fiber). The modified fabric was conditioned at standard atmospheric conditions (65% RH/70° F.) and evaluated for its thermal and non-thermal properties. It absorbed thermal energy after one heating cycle (−40 to +70° C.) of 15.5 Joules/gram, with maximum absorption (cooling effect) at 16° C.; conversely, on cooling from +70 to −40° C., it released heat of 8.0 Joules/gram, with maximum heat release at −4° C. In contrast, unmodified cotton fabric exhibited no heat absorption and heat release effects when heated or cooled in the above temperature ranges. Other textiles properties in the treated fabric were improved relative to the untreated cotton fabric: (a) flex abrasion cycles to failure (16,461 for treated vs 543 for untreated); (b) conditioned wrinkle recovery angle-warp+fill directions (269° for treated vs 199° for untreated); (c) oily soil release measured by method in Example 2 (reflectance retention of 99% for treated vs 78% for untreated); (d) residual static charge in ohms×$10^8$ at 65% relative humidity (2,267 for treated vs 16,105 for untreated); (e) % moisture content—water loss after heating to constant weight at 110° C. (12.0 for treated vs 7.6 for untreated).

EXAMPLE 4

Durability of Polyacetal (derived from reaction of av. molecular wt. PEG-1,000, p-toluenesulfonic acid and glyoxal) in cotton Fabric Given a Pre- and Post Alkaline Treatment The modified fabric in Example 3 was subjected to 20 standard home launderings (washing and drying cycles). Half of the bound polyacetal was retained after 20 launderings and thermal and non-thermal properties of the laundered fabric were determined. It absorbed thermal energy after one heating cycle (−40 to +70° C.) of 8.4 Joules/gram, with maximum absorption (cooling effect) at 16° C.; conversely, on cooling from +70 to −40° C., it released heat of 5.4 Joules/gram, with maximum heat release at 5° C. In contrast, unmodified cotton fabric exhibited no heat absorption and heat release effects when heated or cooled in the above temperature ranges. Other textile properties in the treated fabric were improved relative to the untreated cotton fabric: (a) flex abrasion cycles to failure (2,115 for treated vs 920 for untreated); (b) conditioned wrinkle recovery angle-warp+fill directions (2570 for treated vs 199° for untreated); (c) oily soil release expressed and % retention of reflectance (99 for treated vs 83 for untreated); (d) residual static charge in ohms×$10^8$ at 65% relative humidity (3,075 for treated vs 9,552 for untreated); (e) % moisture content—water loss to constant weight at 110° C. (9.3 for treated vs. 7.6 for untreated).

EXAMPLE 5

Attempts to Incorporate Polyacetal (derived from reaction of av. molecular wt. PEG-1,000 and glyoxal with catalytic amounts of p-toluenesulfonic acid monohydrate or with stoichiometric amounts of a mixed acid catalyst) into 50/50 Cotton/Polyester Fabric 50/50 cotton/polyester sheeting or printcloth (4.1 oz/$yd^2$; 12 in. wide×16 in. long) was immersed in an aqueous solution containing by weight 45% polyethylene glycol av. mol. wt. 1,000 (0.045 moles)—14.4% glyoxal (0.248 moles)-2% p-toluenesulfonic acid monohydrate (0.01 moles) at 25° C., then excess solution removed by running the treated fabric through squeeze rolls at 40 lbs. pressure to a wet pickup of 73%. The fabric was then mounted on a pin frame, dried 5 min. at 85° C. in a forced-draft oven, then cured an additional 2 min. at 140° C. in the same oven. The treated fabric was subsequently washed for 15 min. at 50° C. with running tap water and liquid detergent prior to tumble drying or oven drying for 5 min. at 85° C. The resultant fabric had no weight gain or add-on. If 19% of a 5/1 molar ratio of a mixed acid catalyst ($MgCl_2.6H_2$-0.082 mole/0.017 mole of citric acid or 16.7 g/3.4 g) was used instead of 2% p-toluenesulfonic acid (catalytic amount) or of 19% p-toluenesulfonic acid (stoichiometric amount), and the fabric dried and cured under the same conditions, the resultant fabric also exhibited no increase in weight after washing and drying. This demonstrates that stoichiometric amounts of sulfonic acids must be used to form polyacetals in the presence of the fiber and that other acid catalysts (even in stoichiometric amounts) do not result in the formation of polyacetals.

EXAMPLE 6

Incorporation of Polyacetal (derived from reaction of av. molecular wt. PEG-1,000, p-toluenesulfonic acid and glyoxal) into 50/50 Cotton/Polyester Fabric 50/50 cotton/polyester sheeting or printcloth (4.1 oz/$yd^2$; 12 in. wide×16 in. long) was immersed in the same solution as that described in Example 2 (using 19.0% p-toluenesulfonic acid monohydrate (0.10 mole) and excess solution removed to give a fabric with a wet pickup of 97%. After drying, curing and washing this cotton/polyester blend fabric under the same conditions used for the cotton fabric in Example 2, the resultant fabric had a weight gain or add-on of 40% (0.40 grams per gram of fiber) The modified fabric was conditioned at standard atmospheric conditions (65% RH/70° F.) and evaluated for its thermal and non-thermal properties. It absorbed thermal energy after one heating cycle (−40 to +70° C.) of 15.9 Joules/gram, with maximum absorption (cooling effect) at 15° C.; conversely, on cooling from +70 to −40° C., it released heat of 8.8 Joules/gram, with maximum heat release at −6° C. In contrast, unmodified 50/50 cotton/polyester fabric exhibited no heat absorption and heat release effects when heated or cooled in the above temperature ranges. Other textile properties in the treated fabric were improved relative to the untreated cotton fabric: (a) flex abrasion cycles to failure (6,211 for treated vs 2,816 for untreated); (b) flat abrasion cycles to failure (776 for treated vs 434 for untreated); (c) breaking strength (70 lb for treated vs 79 lb for untreated); (d) oily soil release expressed as % reflectance retention (91 for treated vs 70 for untreated); (e) residual static charge in ohms×$10^8$ at 65% relative humidity (1,531 for treated vs 19,834 for untreated); (e) % moisture content—water loss after heating to constant weight at 110° C. (8.4 for treated vs 4.5 for untreated).

EXAMPLE 7

Incorporation of Polyacetal (derived from reaction of av. molecular wt. PEG-1,000, P-toluenesulfonic acid and glyoxal) into 50/50 Cotton/Polyester Fabric Given a Pre- and Post Alkaline Treatment 50/50 cotton/polyester sheeting or printcloth (4.1 oz/$yd^2$; 12 in wide×16 in. long) was immersed in aqueous 25% NaOH for 5 min. at 25° C., then washed in running tap water for 15 min., dried for 5 min. at 85° C. The pretreated cotton/polyester fabric was then immersed in a solution used in Example 2 to a wet pickup of 95%, and also dried and cured as in Example 2. The cured fabric was post-treated with 25% NaOH for 2 min. at 25° C., washed in running tap water for 15 min. or until the wash water was slightly alkaline, then oven-dried for 5 min. at 85° C. The resultant blend fabric had a weight gain or add-on of 40% (0.40 grams per gram of fiber). The modified fabric was conditioned at standard atmospheric conditions (65% RH/70° F.) and evaluated for its thermal and non-thermal properties. It absorbed thermal energy after one heating cycle (−40 to +70° C.) of 15.3 Joules/gram, with maximum absorption (cooling effect) at 16° C.; conversely, on cooling from +70 to −40° C., it released heat of 7.8 Joules/gram, with maximum heat release at −3° C. In contrast, unmodified cotton fabric exhibited no heat absorption and heat release effects when heated or cooled in the above temperature ranges. Other textile properties in the treated blend fabric were improved relative to the untreated blend fabric: (a) flex abrasion cycles to failure (9,652 for treated vs 2,816 for untreated); (b) conditioned wrinkle recovery angle-warp+fill directions (275 for treated vs 262 for untreated); (c) oily soil release expressed as % reflectance retention (98 for treated vs 70 for untreated); (d) residual static charge in ohms×$10^8$ at 65% relative humidity (1,798 for treated vs 19,834 for untreated); (e) % moisture content—water loss after heating to constant weight at 110° C. (8.7 for treated vs 4.5 for untreated).

EXAMPLE 8

Durability of Polyacetal (derived from reaction of av. molecular wt. PEG-1,000, p-toluenesulfonic acid and glyoxal) in 50/50 Cotton Polyester Fabric Given a Pre- and Post Alkaline Treatment The modified fabric in Example 7 was subjected to 20 standard home launderings (washing and drying cycles). 42% of the bound polyacetal was retained after 20 launderings and thermal and non-thermal properties of the laundered fabric were determined. It absorbed thermal energy after one heating cycle (−40 to +70° C.) of 9.0 Joules/gram, with maximum absorption (cooling effect) at 12° C.; conversely, on cooling from +70 to −40° C., it released heat of 4.3 Joules/gram, with maximum heat release at 7° C. In contrast, unmodified cotton/polyester fabric exhibited no heat absorption and heat release effects when heated or cooled in the above temperature ranges. Other textile properties in the treated fabric were improved relative to the untreated cotton/polyester fabric: (a) flex abrasion cycles to failure (4,305 for treated vs 2,980 for untreated); (b) conditioned wrinkle recovery angle-warp+fill directions (290 for treated vs 254 for untreated); (c) oily soil release expressed as % reflectance retention (90 for treated vs 77 for untreated); (d) residual static charge in ohms×$10^8$ at 65% relative humidity (2,048 for treated vs 12,248 for untreated); (e) % moisture content—water loss after heating to constant weight at 110° C. (8.2 for treated vs 4.0 for untreated).

EXAMPLE 9

Incorporation of Polyacetal (derived from reaction of av. molecular wt. PEG-1,450, p-toluenesulfonic acid and glyoxal) into Aramid (Nomex) and Wool/Polyester Blend Fabrics 100% nonwoven Nomex (aromatic polyamide or aramid) fabric and 55/45 polyester/wool knit fabric (weights of 1.0 and 5.0 oz/yd$^2$, respectively) were immersed in an aqueous solution containing by weight 45% polyethylene glycol av. mol. wt. 1,450 (0.031 moles)—14.4% glyoxal (0.248 moles)—19.0% P-toluenesulfonic acid monohydrate (0.10 moles) at 25° C., then excess solution removed by running the treated fabric through squeeze rolls at 30 lbs. pressure to a wet pickup of 290% for the Nomex and 82% for polyester/wool blend fabric. Each fabric was then mounted on a pin frame, and dried/cured in a single step (0.75 min. at 140° C. for the Nomex and 2 min. at 140° C. for the blend fabric in a forced-draft oven. The treated fabrics were subsequently washed for 15 min. at 50° C. with running tap water and liquid detergent prior to oven drying for 3 min. at 85° C. The modified Nomex fabric had a weight gain or add-on of 27% (0.27 grams per gram of fiber) and the modified polyester/wool fabric an add-on of 34% (0.34 grams per gram of fiber). The modified fabrics were conditioned at standard atmospheric conditions (65% RH/70° F.) and evaluated for their thermal properties. The modified Nomex fabric absorbed thermal energy after one heating cycle (−40 to 70° C.) of 13.4 Joules/gram, with maximum absorption (cooling effect) at 43° C.; conversely, on cooling from +70 to −40° C., it released heat of 13.8 Joules/gram, with maximum heat release at 15° C. The modified blend fabric absorbed thermal energy after one heating cycle (−40 to +70° C.) of 13.8 Joules/gram, with maximum absorption (cooling effect) at 23 and 35° C.; conversely, on cooling from +70 to −40° C., it released heat of 12.6 Joules/gram, with maximum heat release at 8° C. In contrast, unmodified Nomex and wool/polyester fabrics exhibited no heat absorption and heat release effects when heated or cooled in the above temperature ranges. The oily soil release (using the test described in Example 2) of both treated fabrics were dramatically improved (reflectance retention of 99%) relative to the untreated control fabrics (only 68% reflectance retention for the Nomex and 55% retention of reflectance for the 55/45 polyester/wool fabric). Reduction in static charge at 65% relative humidity was also substantial for both treated fabrics relative to corresponding untreated fabrics (6,500×$10^8$ ohms for treated Nomex vs 43,600×$10^8$ ohms for untreated Nomex; and 9,400×$10^8$ ohms for treated 55/45 polyester/wool fabric vs 255,000×$10^8$ for untreated 55/45 polyester/wool fabric).

EXAMPLE 10

Incorporation of Polyacetal (derived from reaction of av. molecular wt. PEG-1,450, p-toluenesulfonic acid and glyoxal) into Polypropylene Fabric 100% woven polypropylene fabric (5.2 oz/yd$^2$) was immersed in the same solution described in Example 8, and excess liquid removed to a wet pickup of 110%. The fabric was then mounted on a pin frame, and dried/cured in a single step (2.5 min. at 140° C.) in a forced-draft oven. The treated fabric was subsequently washed for 15 min. at 50° C. with running tap water and liquid detergent prior to oven drying for 3 min. at 85° C. The modified polypropylene fabric had a weight gain or add-on of 27% (0.27 grams per gram of fiber). The modified fabric was conditioned at standard atmospheric conditions (65% RH/70° F.) and evaluated for its thermal and non-thermal thermal properties. The modified polypropylene fabric absorbed thermal energy after one heating cycle (−40 to +70° C.) of 13.4 Joules/gram, with maximum absorption (cooling effect) at 43° C.; conversely, on cooling from +70 to −40° C., it released heat of 13.8 Joules/gram, with maximum heat release at 15° C. The treated polypropylene fabric also had improved non-thermal properties as follows: (a) flex abrasion cycles to failure (26,600 for treated vs 3,830 for untreated); (b) oily soil release express as % reflectance retained (96% treated vs 50% for untreated); (c) static charge remaining on the fabrics at 65% relative humidity at ohms×$10^8$ (1,075 for treated vs 6,077,528 for untreated); and (d) % moisture content—water loss after heating to constant weight at 110° C. (3.4 for treated vs 0.45 for untreated).

EXAMPLE 11

Incorporation of Polyacetal (derived from reaction of av. molecular wt. PEG-3,350, methanesulfonic acid and glyoxal) into Cotton Fabrics 100% desized, scoured and bleached cotton printcloth (3.7 oz/yd$^2$; thread count 80 warp×80 fill; 12 in. wide×16 in. long) was immersed in an aqueous solution containing by weight 52% polyethylene glycol av. mol. wt. 3,350 (0.015 moles)—14.4% glyoxal (0.248 moles)—3% methanesulfonic acid (0.031 moles) at 25° C., then excess solution removed by running the treated fabric through squeeze rolls at 40 lbs. pressure to a wet pickup of 100%. The fabric was then mounted on a pin frame, dried 5 min. at 85° C. in a forced-draft oven, then cured an additional 2 min. at 145° C. in the same oven. The treated fabric was subsequently washed for 15 min. at 50° C. with running tap water and liquid detergent prior to tumble drying or oven drying for 5 min. at 85° C. The resultant fabric had no weight gain. However, when the fabric was treated with a solution containing 6% methanesulfonic acid (0.006 moles) and concentrations of polyol and glyoxal held constant, cotton fabric cured under identical conditions had a weight gain or add-on of 15% (0.15 grams per gram of fiber). The latter modified cotton fabric absorbed thermal energy after one heating cycle (−40 to +70° C.) of 10.6 Joules/gram, with maximum absorption (cooling effect) at 18° C.; conversely, on cooling from +70 to −40° C., it released heat of 8.5 Joules/gram, with maximum heat release at −2° C.

EXAMPLE 12

Incorporation of Polyacetal (derived from reaction of av. molecular wt. PEG-20,000, p-toluenesulfonic acid and glyoxal) into 65/35 Cotton/Polyester Fabric 65/35 cotton/polyester sheeting (2.4 oz/yd$^2$; thread count 80 warp×80 fill; 12 in. wide×16 in. long) was immersed in an aqueous solution containing by weight 30% polyethylene glycol av. mol. wt. 20,000 (0.0015 moles)—12.3% glyoxal (0.21 moles)—16.3% p-toluenesulfonic acid monohydrate (0.08 moles) at 25° C., then excess solution removed by running the treated fabric through squeeze rolls at 50 lbs. pressure to a wet pickup of 100%. The fabric was then mounted on a pin frame, and dried and cured in a single step (3 min. at 135° C. in a forced-draft oven). The treated fabric was subsequently washed for 15 min. at 50° C. with running tap water and liquid detergent prior to tumble drying. The resultant fabric had a weight gain or add-on of 18.2% (0.182 grams per gram of fiber). The modified fabric was conditioned at standard atmospheric conditions (65% RH/70° F.) and evaluated for its thermal and non-thermal properties. The modified cotton/polyester fabric absorbed thermal energy after one heating cycle (0 to +100° C.) of 19.2 Joules/gram, with maximum absorption (cooling effect) at 55° C.; conversely, on cooling from +100 to 0° C., it released heat of 14.9 Joules/gram, with maximum heat release at 33° C. In contrast, unmodified cotton/polyester fabric exhibited no heat absorption and heat release effects when heated or cooled in the above temperature ranges. The treated blend fabric also had improved non-thermal properties as follows: (a) flex abrasion cycles to failure (2,025 for treated vs 1,060 for untreated); (b) conditioned wrinkle recovery angle-warp+fill directions (304 for treated vs 230 for untreated); (e) % moisture content—water loss after heating to constant weight at 110° C. (3.4 for treated vs 2.8 for untreated).

We claim:

1. Temperature adaptable fibers having improved storage and release properties, said fibers having deposited thereon a water-insoluble polyacetal polymer, wherein said polyacetal polymer is the stoichimetric reaction product of a polyethylene glycol constituent that represents one or more polyethylene glycols having a molecular weight from about 600 to about 100,000, a sulfonic acid and a glyoxal constituent, with said polyacetal polymer being present in an amount effective to cause said fibers to store heat when the temperature rises and release heat when the temperature decreases.

2. The fibers of claim 1 wherein said fibers are selected from the group consisting of wood pulp, paper, cellulosic fibers, regenerated cellulosic fibers, proteinaceous fibers, polyesters, polypropylenes, polyamids, glass, acrylics, elastomerics, and blends thereof.

3. The fibers of claim 1 wherein said sulfonic acid constituent is p-toluenesulfonic acid, methanesulfonic acid or mixtures thereof.

4. The fibers of claim 1 wherein said glyoxal constituent is glyoxal, glyoxal trimer dihydrate or mixtures thereof.

5. The fibers of claim 1 wherein the polyacetal polymer is present on said fibers in an amount ranging from about 0.1 g to about 1 g of polyacetal per gram of fibrous material.

6. The fibers of claim 1 wherein said fibers have improved properties as to soil release, durable press, resistance to static charge, abrasion resistance, pilling resistance and water absorbency.

* * * * *